United States Patent [19]

Kratz

[11] Patent Number: 5,071,189

[45] Date of Patent: Dec. 10, 1991

[54] CHAIR WITH ADJUSTMENT FEATURE

[75] Inventor: Günter Kratz, Hochdorf, Fed. Rep. of Germany

[73] Assignee: Roeder GmbH, Frankfurt, Fed. Rep. of Germany

[21] Appl. No.: 606,873

[22] Filed: Oct. 31, 1990

Related U.S. Application Data

[63] Continuation-in-part of. Ser. No. 357,042, May 25, 1989, abandoned.

[30] Foreign Application Priority Data

May 26, 1988 [DE] Fed. Rep. of Germany ..... 3817761

[51] Int. Cl.[5] ..... A47C 1/02

[52] U.S. Cl. ..... 297/301; 297/316; 297/320

[58] Field of Search ..... 297/320, 321, 322, 323, 297/225, 326, 316, 301, 302, 303, 299, 280

[56] References Cited

U.S. PATENT DOCUMENTS

| | | | |
|---|---|---|---|
| 4,502,729 | 3/1985 | Locher | 297/320 X |
| 4,509,793 | 4/1985 | Wiesmann et al. | 297/316 X |
| 4,560,199 | 12/1985 | Sapper | 297/320 X |
| 4,640,547 | 2/1987 | Fromme | 297/320 X |
| 4,703,974 | 11/1987 | Brauning | 297/323 X |
| 4,758,045 | 7/1988 | Edel et al. | 297/322 X |
| 4,765,679 | 8/1988 | Lanuzzi et al. | 297/316 |
| 4,773,706 | 9/1988 | Hinrichs | 297/316 X |
| 4,804,227 | 2/1989 | Hansen | 297/316 X |
| 4,834,453 | 5/1989 | Makiol | 297/301 |
| 4,848,837 | 7/1989 | Volkle | 297/316 X |

FOREIGN PATENT DOCUMENTS

| | | | |
|---|---|---|---|
| 608327 | 5/1948 | United Kingdom | 297/321 |

*Primary Examiner*—Jose V. Chen

*Attorney, Agent, or Firm*—Jansson & Shupe, Ltd.

[57] ABSTRACT

A chair with an automatic adjustment feature includes a seat coupled by engaging links to a plurality of support arms for relative pivoting and translational movement with respect to such arms. The seat has an upwardly extending rear extension connected to the back rest by an adjusting element. A pivot lever is disposed at either side of the seat, each lever having a first end pivotably pinned to a support arm, a second end attached to the back rest and a hinge pin disposed intermediate such ends and coupling the pivot lever to the seat. The element is of the self-adjusting type for permitting relative linear movement between the rear extension and the back rest while yet preventing bending movement between such extension and such back rest. The positional relationship of the rear extension and the back rest to one another is automatically adjusted as the chair is moved between an upright position and a reclining position.

10 Claims, 4 Drawing Sheets

CHAIR WITH ADJUSTMENT FEATURE

RELATED APPLICATIONS

This application is a continuation-in-part of copending U.S. application Ser. No. 357,042 which was filed on May 25, 1989, now abandoned and claims priority from Federal Republic of Germany application serial no. P 38 17 761.7-16 filed on May 26, 1988.

FIELD OF THE INVENTION

This invention is related generally to chairs and, more particularly, to a chair wherein the seat member is positionable through an angle of movement. As the seat member is so positioned, the back support simultaneously moves through a larger angle of movement. The back support and seat member are joined by an adjustment element which extends or retracts, depending upon the selected position of the seat member.

BACKGROUND OF THE INVENTION

Known chairs of the adjustable type are extremely comfortable, due in large part to the practically vertical position of the back rest. They provide firm support for the user in the starting or working position and, after the back rest has been tilted backward, they also permit more relaxed seating. When positioning the back rest forward or backward in known chairs, the upper body of the user both pivots and undergoes forward or rearward movement. Since the back rest undergoes similar movement, relative movement between the back of the user and the back rest is avoided or at least reduced to an insignificant extent.

Other types of chairs are constructed in a manner such that as the seat member and back are tilted, the back of the user (that body part in contact with the back rest) experiences significant relative movement with respect to the back rest of the chair.

As shown in European Patents 85,670 B1, 176,816 A1 and German Patent 2,916,897 A1, this compensates for the relative movement between the body of the user and the back rest may be solved in different ways. The chair may be designed as a synchronized chair whereby a angular movement of the seat support causes a backward tilt of the back panel, but through a greater angle of movement. See, for example, FIGS. 1 and 3 of European Patent 85670. The seat support may also be mounted on a bearing block in such a way that it must be moved forward as the back is tilted rearward. Compare the relative positions of the seat supports in FIGS. 1 and 2 of German Patent 29 16 897. As exemplified in known chairs, a relatively complex support and pivoting apparatus is desirable for changing the slope of the back rest. However, such mechanisms do not always function satisfactorily, i.e., reliably and free of trouble.

Multiple linkage levers such as those described in European Patent 176,816 A1 or other transmission lever pairs and engaging levers, as described in European Patent 85,670 B1, are used in such cases. In each case, many parts are needed to achieve the adjustment feature. The same thing is also true of a chair according to German Patent 2,916,897 A1, where the back rest is movable downward on the back when the seat is moved forward for more reclined seating.

Another disadvantage of these known chairs is that in certain of them, the adjustment attachment points must permit lateral displacement movement as well as pivoting movement of the connected parts. Therefore, the design of these attachment points is usually complicated and less reliable in operation.

OBJECTS OF THE INVENTION

An object of the invention is to overcome the shortcomings of the prior art, some of which are described above.

Another object of the invention is to provide a chair having a positionally adjustable seat and back rest using linkages selectively arranged for pivoting movement only.

Still another object of the invention is to provide a chair having pivot levers rigidly attached to a back rest.

Yet another object of the invention is to provide a chair wherein when the chair seat is angularly adjusted, the angular excursion of the back rest is greater than that of the seat.

Another object of the invention is to provide a chair wherein the axis of pivoting angular movement of the seat is positioned generally intermediate the front edge and rear extremity of the seat.

How these and other objects of the invention are met will become apparent from the detailed description thereof taken in conjunction with the drawing.

SUMMARY OF THE INVENTION

A chair with an automatic adjustment feature includes a seat coupled by engaging links to a plurality of support arms for relative pivoting and translational movement with respect to such arms. The seat has an upwardly extending rear extension connected to the back rest by an adjusting element. A pivot lever is disposed at either side of the seat, each lever having a first end pivotably pinned to a support arm, a second end attached to the back rest and a hinge pin disposed intermediate such ends and coupling the pivot lever to the seat. The element is of the self-adjusting type for permitting relative linear movement between the rear extension and the back rest while yet preventing bending movement between such extension and such back rest. The positional relationship of the rear extension and the back rest to one another is automatically adjusted as the chair is moved between an upright position and a reclining position.

In a highly preferred embodiment, the second end of the pivot lever is rigidly attached to the back rest, thereby preventing substantial bending movement between such back rest and such pivot lever. The pivot levers may be constructed to be sharply sloping or more nearly horizontal. In the latter instance, such levers function as arm rests for a user of the chair. The coupling pins which connect the pivot levers to the support arms are below the upper ends of the engaging links for all positions of the chair.

The seat pivots about a pin, the locus of which changes with changes in position of the seat. This permits such seat to exhibit both pivoting angular movement and translational movement as the chair is moved between upright and reclining positions.

The self-adjusting element may be embodied as a telescoping joint or as a bellows. In either instance, such element permits the back rest and the seat extension to move closer to or farther from one another while yet preventing bending movement between the rest and the extension.

The chair is made more comfortable when the seat is formed to include a body-fitting support surface with an upwardly directed, curved extension at the rear edge of the seat. The extension cooperates with the lower edge of the back rest to define a generally form-fitting, back supporting contour surface.

More specifically, the first end of the pivot lever includes a lower segment extending generally vertically downward and attached to a support arm by a coupling pin. An engaging link extends between each support arm and the seat, each such link including an upper end pivotably pinned to the seat to define a horizontal pivot axis and a lower end pivotably pinned to a support arm by a link pin. Such construction permits translational and pivoting movement of the seat with respect to the support arm. When so constructed, the angular excursion experienced by the back rest is greater than that experienced by the seat as the chair is moved between the upright and reclining positions.

DETAILED DESCRIPTION OF PREFERRED EMBODIMENTS

The figures show the chair 9 in accordance with the invention.

Figure 1:
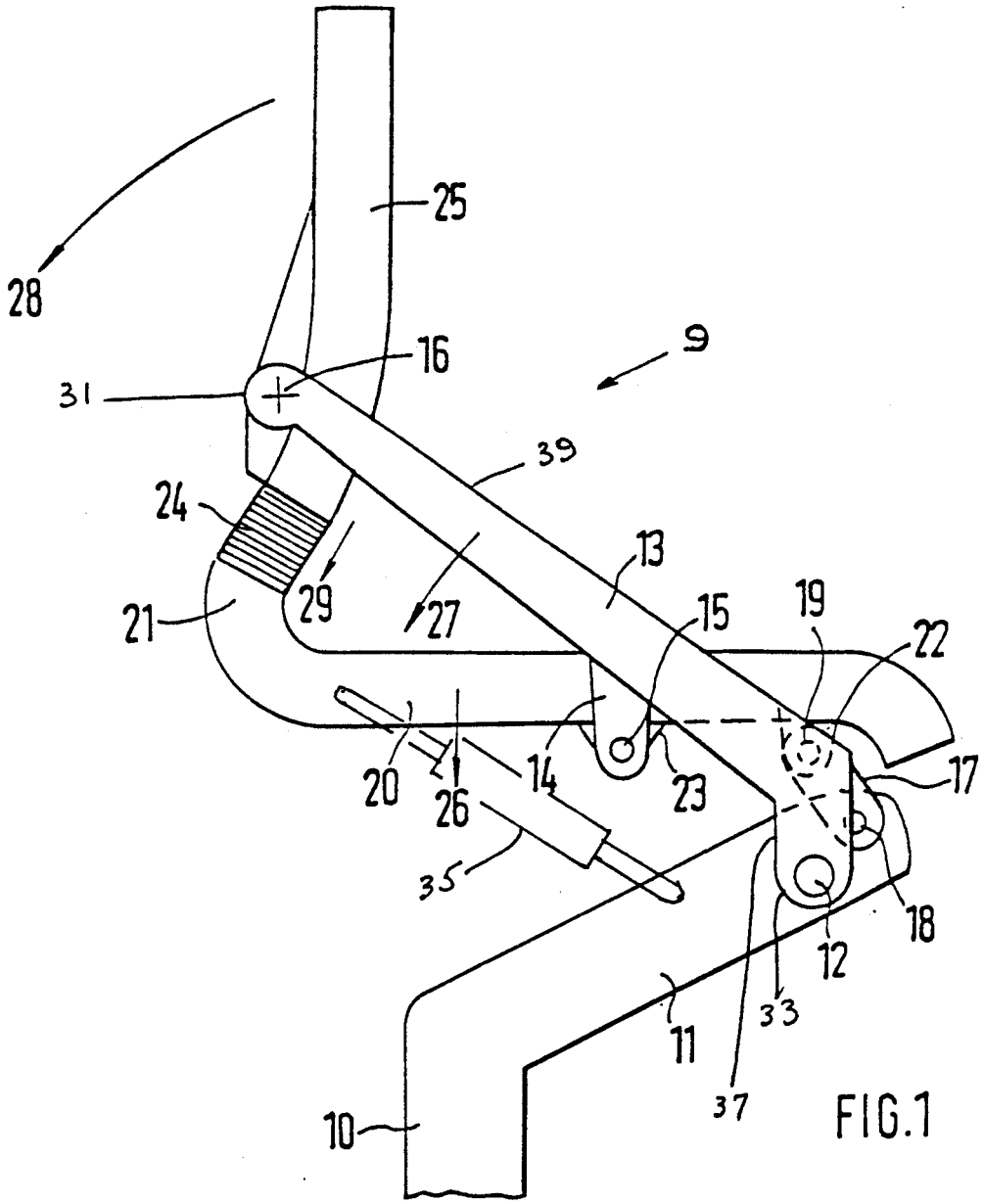
FIG. 1 is a right side elevation view of the chair in an upright position, with parts shown in dotted outline and other away.
Figure 2:
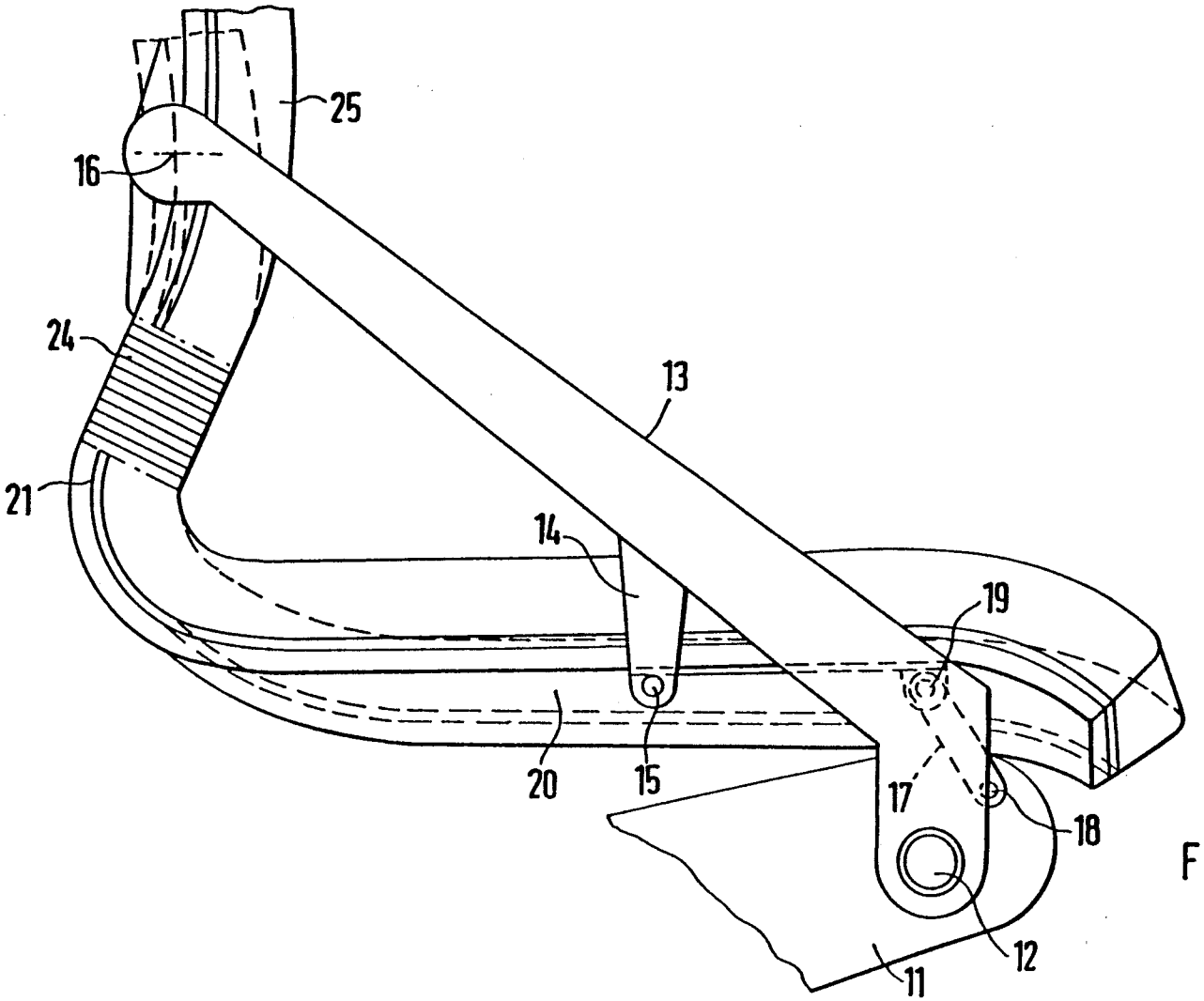
FIG. 2 is a right side, enlarged elevation view of the chair in an upright position, with upholstery or padding added, with parts shown in dotted outline and with parts broken away.
Figure 3:
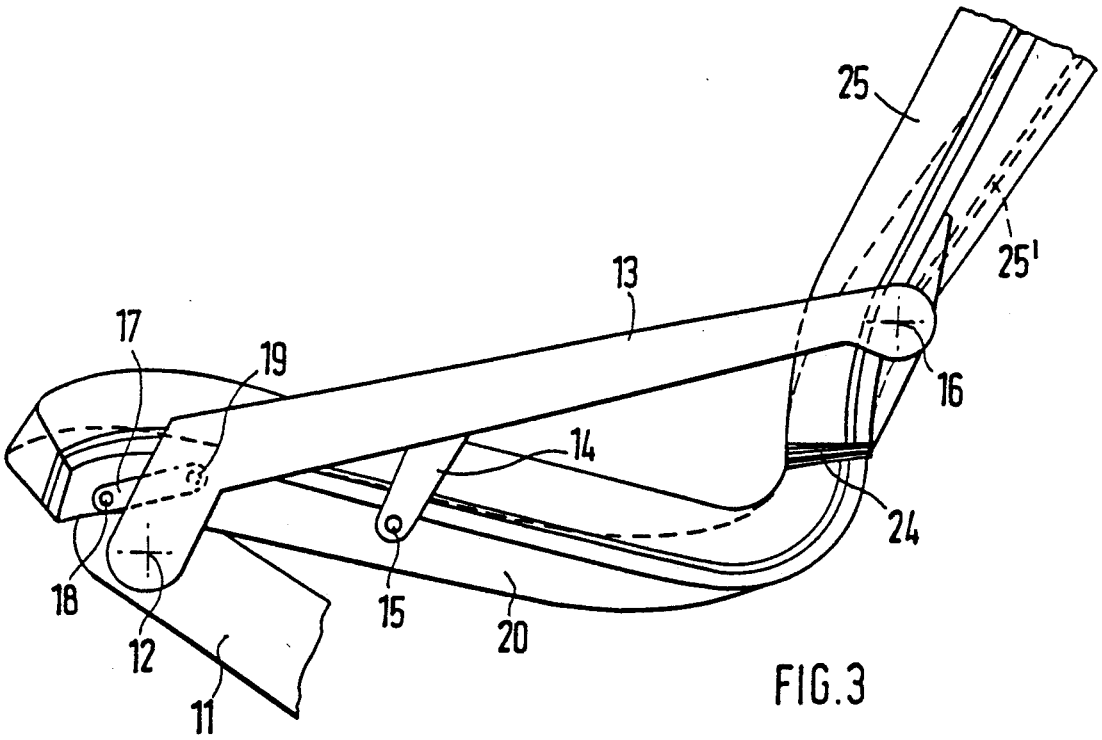
FIG. 3 is a left side elevation view of the chair of FIG. 2 with parts shown in dotted outline, with parts broken away and with the chair shown in a reclining position.

Referring first to FIG. 1, the chair 9 is shown to include a seat 20 and back rest 25. Such seat 20 and back rest 25 are supported (along with other components of the chair 9) above a surface such as a floor by a pedestal or column 10 which includes a pair of upwardly, forwardly extending support arms 11. The seat is supported in a known way by an extensible spring or cylinder 35 coupled between a support arm 11 and the seat 20. Such spring or cylinder 35 is preferably adjustable to permit the supporting force exerted thereby to conform to those required by chair users of differing weights A rigidly-constructed pivot lever 13 is coupled to the arm 11 by a coupling pin 12 to pivot on such pin 12. The upper end 31 of the pivot lever 13 is rigidly attached to the seat back 25 at point 16 to prevent relative rotational, bending or other movement between the pivot lever 13 and the back 25. As shown in FIGS. 1-3, the pivot lever 13 functions primarily as a mechanical linkage. However, the pivot lever 13 may be rigidly constructed so that its lower segment 37 extends upward a greater distance, thereby bringing the arm 39 more toward a horizontal position. When upholstered or padded, arm 39 thereby functions as an arm rest for the user. It is apparent that if lever 13 is so constructed, strap 14 would be lengthened. Further, the entire seat 20 and back rest 25 may be padded, upholstered and/or sculpted as shown in FIGS. 2 and 3 to provide greater comfort and a more aesthetically-pleasing appearance.

The upper end of the downwardly-extending bearing strap 14 is rigidly coupled to the pivot lever 13 at a point intermediate the lower end 33 and the upper end 31. The lower end of such strap 14 is pivotably attached to the seat 20 by a hinge pin 15. An engaging link 17 extends between a seat strap 22 (located near the front edge of the seat 20) and the support arm 11, such link 17 being pivotably pinned at its upper end to strap 22 by a pin 19 and at its lower end to arm 11 by link pin 18. Link pin 18 is positioned forward of and slightly above coupling pin 12 and when the chair 9 is in the upright position as shown in FIG. 1, pin 19 is positioned approximately directly above coupling pin 12.

Figure 4:
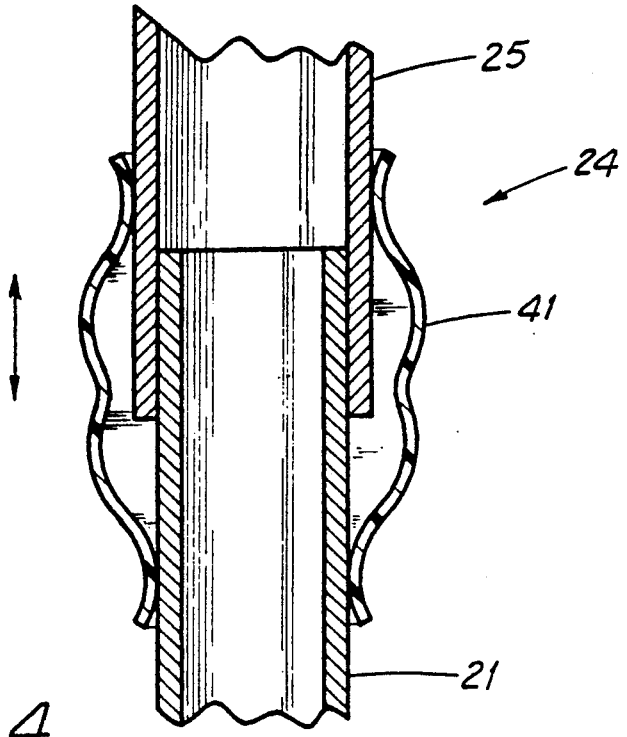
FIG. 4 is a cross-sectional side elevation view, with parts broken away, of the chair adjusting element embodied as a telescoping joint.
Figure 5:
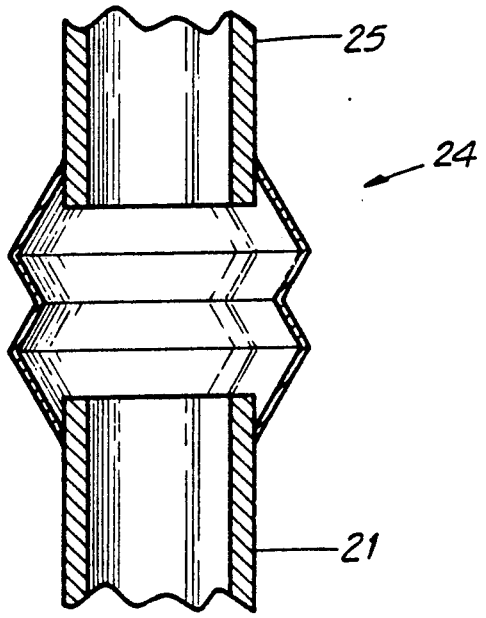
FIG. 5 is a cross-sectional side elevation view, with parts broken away, of the chair adjusting element embodied as a bellows.

The rear portion of seat 20 terminates in an upward-curving extension 21 which is attached to the lower portion of the back rest 25 by an adjusting element 24. This adjusting element 24 primarily functions as a juncture between the back rest 25 and the extension 21 and has a variable length capability. More specifically, one embodiment of the adjusting element 24 is embodied as a telescoping joint as shown in FIG. 4 to permit linear sliding movement between the back rest 25 and the seat extension 21. In this embodiment, the joint is covered by a boot 41 for aesthetic and protective purposes. Another embodiment of the adjusting element 24 is shown in FIGURE 5 as a bellows to permit linear relative movement between the back rest 25 and the seat extension 21. Irrespective of whether element 24 is embodied as a telescoping joint or a bellows (or other type of similar element), adjusting element 24 prohibits bending movement, only permitting rest 25 and extension 21 to move closer to or farther from one another.

It is to be appreciated that element 24 is self-adjusting to permit variations of the positional relationship of the back rest 25 and the rear extension 21 to one another. That is, as the chair 9 is moved to a reclining position, the opposing forces exerted on element 24 by the back rest 25 and the extension 21 urge rest 25 and extension 21 toward one another. The length of element 24 is responsively diminished. As the chair 9 is moved toward the upright position, such opposing forces urge rest 25 and extension 21 away from one another and the length of element 24 is responsively increased.

When the seat 20 is moved from the upright position (as shown in FIGS. 1 and 2) through a partially reclining position to a more reclining position (as shown in FIG. 3), link 17 rotates counter clockwise and seat 20 exhibits both translational and angular pivoting movement with respect to the stationary support arms 11. That is, the seat 20 moves slightly rearward and also moves angularly downward, the latter movement being indicated by arrow 26. During and following such movement, the rear portion of the seat 20, that portion adjacent extension 21, comes to a position lower than the front edge of the seat 20. In so moving, pivot lever 13 moves counter clockwise in the direction of arrow 27 toward (but not to) a horizontal position. The back rest 25 also experiences angular movement as denoted by arrow 28 as well as downward movement.

The angular movement experienced by the back rest 25 is greater than that experienced by the seat 20. Further, as the seat is reclined, the length of the adjusting element 24 will be diminished as shown by a comparison of the length of such element 24 in FIGS. 1 or 2 with the length of the element shown in FIG. 3.

From a comparison of FIGS. 2 and 3 and the relative locations of pins 12 and 19 one to the other, it will be appreciated that with the chair 9 in the upright position, the pin 19 is positioned generally vertically above pin 12. When the chair is in the reclining position, pin 19 will be located rearward but still slightly above pin 12. It will also be appreciated that the seat 20 generally pivots about pin 19 even though the locus of pin 19 changes as the chair 9 is moved between upright and reclining positions.

The limit of travel of the seat 20 and the back rest 25 are approximately shown by the dashed lines in FIG. 3 and by the position of the back rest 25 denoted as position 25'. It is to be appreciated that the dashed lines in FIGS. 2 and 3 are intended to show positions of the seat 20 and back rest 25. Conversely, such dashed lines are not intended to show relative bending movement between back rest 25 and extension 21 and in fact, no such relative bending movement occurs or is capable of occurring, given the aforedescribed construction of element 24.

While the principles of this invention have been described in connection with specific embodiments, it should be understood clearly that these descriptions are made only by way of example and are not intended to limit the scope of the invention.

What is claimed is:

1. A chair with an automatic adjustment feature including:

seat coupled by engaging links to a plurality of support arms for relative pivoting and translational movement with respect thereto, such seat having an upwardly extending rear extension;

a back rest providing reclining support for a user of the chair;

a pivot lever disposed at either side of the seat, each of such pivot levers having a first end pivotably pinned to a support arm, a second end attached to the back rest and a hinge pin disposed intermediate such ends and coupling the pivot lever to the seat;

the backrest being urged by the pivot lever toward the rear extension as the chair moves from an upright to a reclining position and away from the rear extension as the chair moves from a reclining position to an upright position;

an element of the self-adjusting type connecting the rear extension and the back rest and permitting relative linear movement between the rear extension and the back rest while yet preventing bending movement therebetween;

whereby the distance between the rear extension and the back rest is automatically adjusted as the chair is moved between an upright position and a reclining position.

2. The chair of claim 1 wherein the second end of the pivot lever is rigidly attached to the back rest, thereby preventing substantial bending movement between such back rest and such pivot lever.

3. The chair of claim 2 wherein the seat pivots about a pin having a changing locus, thereby permitting such seat to exhibit both pivoting angular movement and translational movement as the chair is moved between upright and reclining positions.

4. The claim of claim 3 wherein the self-adjusting element is embodied as a telescoping joint.

5. The chair of claim 1 wherein the self-adjusting element is embodied as a telescoping joint.

6. The chair of claim 1 wherein said pivot levers function as arm rests for a user of said chair.

7. The chair of claim 1 wherein said seat includes a support surface with an upwardly directed, curved extension at the rear edge thereof, said extension cooperating with the lower edge of such back rest to define a generally form-fitting body contour surface

8. The chair of claim 1 wherein the first end of the pivot lever includes a lower segment extending generally vertically downward and attached to a support arm by a coupling pin.

9. The chair of claim 8 wherein an engaging link extends between each support arm and the seat and wherein each of such engaging links includes an upper end pivotably pinned to the seat to define a horizontal pivot axis and a lower end pivotably pinned to a support arm by a link pin, thereby permitting translational and pivoting movement of the seat with respect to the support arm.

10. The chair of claim 9 wherein the coupling pins are located below the upper ends of the engaging links for all positions of the chair.

* * * * *

UNITED STATES PATENT AND TRADEMARK OFFICE

CERTIFICATE OF CORRECTION

PATENT NO. : 5,071,189

DATED : December 10, 1991

INVENTOR(S) : Gunter Kratz

It is certified that error appears in the above-identified patent and that said Letters Patent is hereby corrected as shown below:

In column 3, line 22, after "other" insert --parts broken--.

In claim 1, column 5, line 30, before "seat" insert --a--.

In claim 4, column 6, line 19, delete "3" and insert --1--.

In claim 5, column 6, line 21, delete "1" and insert --3--.

In claim 7, column 6, line 29, after "surface" insert -- . --.

Signed and Sealed this

Twenty-third Day of March, 1993

*Attest:*

STEPHEN G. KUNIN

*Attesting Officer*

*Acting Commissioner of Patents and Trademarks*